US006841264B2

(12) United States Patent
Lunnerfjord et al.

(10) Patent No.: US 6,841,264 B2
(45) Date of Patent: Jan. 11, 2005

(54) DOCTOR OR COATER BLADE AND METHOD IN CONNECTION WITH ITS MANUFACTURING

(75) Inventors: Allan Lunnerfjord, Munkfors (SE); Roland Sundberg, Munkfors (SE); Jan-Åke Gavén, Hagfors (SE)

(73) Assignee: Swedev Aktiebolag, Munkfors (SE)

( * ) Notice: Subject to any disclaimer, the term of this patent is extended or adjusted under 35 U.S.C. 154(b) by 0 days.

(21) Appl. No.: 10/433,771

(22) PCT Filed: Nov. 29, 2001

(86) PCT No.: PCT/SE01/02637

§ 371 (c)(1),
(2), (4) Date: Jan. 13, 2004

(87) PCT Pub. No.: WO02/46526

PCT Pub. Date: Jun. 13, 2002

(65) Prior Publication Data

US 2004/0137261 A1 Jul. 15, 2004

(30) Foreign Application Priority Data

Dec. 7, 2000 (SE) ..... 0004506

(51) Int. Cl.[7] ..... D21G 3/00; C25D 15/00

(52) U.S. Cl. ..... 428/679; 428/935; 162/281; 205/109; 205/110; 15/256.5; 101/157

(58) Field of Search ..... 428/614, 609, 428/612, 687, 680, 679, 935; 162/281; 205/109, 110; 118/261; 15/256.5, 256.51, 256.52; 101/169, 154, 157, 350.6

(56) References Cited

U.S. PATENT DOCUMENTS 3,617,363 A * 11/1971 Metzger et al. ..... 427/383.7
3,909,252 A * 9/1975 Kuriyama et al. ..... 420/9
3,932,228 A * 1/1976 Sugiyama et al. ..... 123/193.2
4,180,048 A * 12/1979 Regan ..... 125/15
4,666,786 A * 5/1987 Yano et al. ..... 428/544
5,076,897 A * 12/1991 Wride et al. ..... 205/110
5,702,574 A * 12/1997 Foster et al. ..... 204/224 R
6,305,282 B1 * 10/2001 Datwyler ..... 101/169
6,355,154 B1 * 3/2002 Buratti ..... 205/109
2002/0182437 A1 * 12/2002 Adamou et al. ..... 428/679
2003/0056313 A1 * 3/2003 Sakurai et al. ..... 15/236.08

FOREIGN PATENT DOCUMENTS

JP 56-075598 * 6/1981
JP 2104696 4/1990
JP 3064595 3/1991
JP 6262145 9/1994
WO WO 9954520 A1 10/1999
WO WO 9964674 A1 12/1999

OTHER PUBLICATIONS

MRL, Bull. Res. Dev., vol. 4, No. 1, 1990, C.Y. Liue et al., "Ni–SiC Composite Plating". pp. 31–34.
C. Dedeloudis et al., "Electrolytic Codeposition of Submicron Silicon Carbide with Nickel," Plating & Surface Finishing, Aug. 1999, p. 57–60.

* cited by examiner

*Primary Examiner*—John J. Zimmerman
(74) *Attorney, Agent, or Firm*—Jeffrey S. Melcher; Manelli Denison & Selter, PLLC

(57) ABSTRACT

The invention relates to a doctor or coater blade (1) of steel, having a nickel coating comprising abrasion resistant particles, said coating being constituted by an electrolytic nickel layer comprising abrasion resistant particles. The coating preferably comprises at least two electrolytic nickel layers having different composition, and may be formed differently in different sections of the blade. The invention also relates to a continuous process for electrolytic nickel coating in at least one electrolytic cell holding an electrolyte liquid comprising at least one nickel salt, and in at least one of these cells also comprising abrasion resistant particles.

42 Claims, 2 Drawing Sheets

DOCTOR OR COATER BLADE AND METHOD IN CONNECTION WITH ITS MANUFACTURING

TECHNICAL FIELD

The present invention relates to a doctor or coater blade, having a nickel coating comprising abrasion resistant particles, e.g. SiC.

PRIOR ART AND PROBLEMS

Doctor and coater blades are used in the manufacturing of paper and in the printing industry, in order to scrape paper and printing ink, respectively, from a rotating roll. In this connection, problems with wear of the roll and of the doctor or coater blade, arise. The problem of wearing of a blade of doctor or coater type has been addressed in a number of patent applications, e.g. SE 8205805, SE 8205806 and SE 8205807, by the provision of a blade that has an abrasion resistant coating. However, this does not solve the problem of wear of the roll but rather increases this problem. For example at so called flexographic printing, the coater blade butts against a ceramic screen roll which is very expensive and which moreover gives rise to a quite considerable wear of the coater blade when the roll is new.

Another problem which is not solved in the mentioned prior art is uneven wear of the blade. In e.g. so called photogravure printing there is, after initial wearing formed a abutment surface on the coater blade which is to abut closely against the print roll during the entire number of copies printed, so that colour pigment does not pass and discolouring ("toning") occurs. During the printing operation, the wear section of the coater blade is worn to max 70% before the coater blade is exchanged. However, usually only about 10–20% of the wear section of the coater blade is used at the pattern surface of the printing roll, before a change is made. This is due to uneven wear, in which a lubrication with the used ink takes place at the pattern surface, while the coater blade is worn much faster outside the pattern surface and at the ends of the printing roll, perhaps all the way down to the part of the coater blade which is outside the actual wear section. Due to this intense wear at the ends of the coater blade, ink leaks onto the pattern surface and it is moreover not rare that fissures form in the surface layer of the coater blade due to effect of forces, whereby the printing must be stopped for ex-changing of the coater blade. Accordingly, this has to be done despite the fact that the coater blade has not been more than 10–20% worn at the pattern surface. Attempts to solve this problem have been made, there having been presented a coater blade which exhibits a larger material thickness at the ends, i.e. in the parts which are intended to be positioned outside the pattern surface. In this case, the coater blade has been ground with a conventional lamella grinding in the wear section but not in the end parts. This grinding is however very complicated to perform and moreover leads to that the coater blade only can be manufactured at final lengths and not in longer pieces for cutting in connection with its use.

Another problem that may arise is the formation of burrs on the top side of the coater blade or doctor blade, in connection with the wear of the same. If these burrs remain on the tip of the blade, the roll may be scored and/or lines may occur in the print (boater blades).

From JP 3 064 595 (abstract), there is known a steel coater blade which exhibits an electrolytically applied coating on its tip. The coating exhibits two layers, an innermost layer of nickel being arranged and an outermost layer of chromium.

From JP 2 104 696 (abstract), there is known a steel doctor blade, which exhibits a coating of Cu, Ni, Zn, Ag, ceramics etc. The patent relates to a masking method in which the blade is rolled together and is thereafter electrolytically coated.

It is further known for doctor blades and coater blades to make use of chemical nickel coatings, i.e. coatings that are not applied by electrolysis, which coatings comprise SiC particles for the improvement of abrasion resistance. These doctor blades or coater blades however exhibit certain drawbacks, e.g. the increased risk of fissure formation and also an increased cost since the entire blade has to be coated.

It is also generally known, within other technical fields, to form a so called composite coating in electrolytic nickel coating of objects. S. H. Yeh & C. C. Wan, "A study of SiC/Ni composite plating in the Watts bath", pp. 54–58, Plating & Surface Finishing, March 1997, and O. Berkh et al., "Electrodeposited Ni—P—SiC composite coatings", pp. 62–65, Plating & Surface Finishing, November 1995 describe how particles of SiC can be included in an electrolyte bath for nickel coating. G. N. K. Ramesh Bapu, "Characteristics of Ni—BN electrocomposites", pp. 70–73, Plating & Surface Finishing, July 1995 describes how hardness and abrasion resistance can be improved in a product by use of BN particles in the electrolytic nickel coating bath. It is also known to include PTFE in an electrolytic nickel coating, with the purpose of decreasing the coefficient of friction between against each other moving parts. Examples of references are G. N. K. Bapu et al., "Electrodeposition of Nickel-Polytetrafluoroethylene (PTFE) polymer composites", pp. 86–88, Plating & Surface Finishing, April 1995 and M. Pushpavanam et al., "Electrodeposited Ni-PTFE dry lubricant coating", pp. 72–75, Plating & Surface Finishing, January 1996.

ACCOUNT OF THE INVENTION

The present invention aims at providing a doctor or coater blade which exhibits a good abrasion resistance without an increased wear on a rotating roll which the blade bears against. Accordingly, the blade according to the invention aims at exhibiting both an even and smooth surface with a lubricating effect and a good abrasion resistance. Moreover, the blade according to the invention aims, by provision of its special design, at optimal uptake of the forces which it is exposed to, in order to avoid fissure formation and to avoid premature wear at the ends of the blade. Yet another objective of the present invention is to present a method for continuous electrolytic nickel coating of such a blade, in at least two layers.

These and other objectives are accomplished by the doctor or coater blade according to the invention and by the method according to the invention, as these are presented in the claims.

According to one aspect of the invention, the blade exhibits a coating which is thicker on the underneath side than on the top side, at least at a wear section of the blade, i.e. a front part of the blade where the steel core exhibits a thickness of about 30–100 $\mu$m, preferably 40–55 $\mu$m (coater blades) or 0.1–0.3 mm (doctor blades). At the wear section, the coating may exhibit a total thickness of 8–25 $\mu$m on the underneath side, preferably 10–20 $\mu$m and even more preferred 13–18 $\mu$m, while the coating on the top side typically exhibits a total thickness of 3–15 $\mu$m, preferably 3–10 $\mu$m, at the wear section. This design of the coating aims at that the forces which the blade is exposed to should be absorbed in the most favourable way. In this connection, it is the case that the blade is exposed to the largest forces on its underneath side, due to the underneath side being the first to meet the roll at its rotation, with a certain abutment force, whereby accordingly the need of a thick coating is largest on the underneath side of the blade.

According to another aspect of the invention, the blade exhibits a section of the coating on its top side, in the following denoted a reinforcement section, which exhibits a largest thickness which is larger than the thickness on the top side of the wear section of the blade and preferably also larger than the thickness of the coating on the underneath side of the wear section of the blade, as seen in the normal against the surface of the blade. The reinforcement section normally exhibits a largest thickness of 10–40 μm, preferably 15–35 μm, as seen in the normal against the surface of the blade. This reinforcement section is arranged at the transition section between the wear section of the blade and the rear part of the blade, on the top side of the blade, with the purpose of absorbing stresses in the surface layer of the blade when the blade has been worn all the way down to or in the vicinity of this transition section, normally first at the parts of the blade that are positioned outside the pattern surface, i.e. the ends of the blade. Thanks to the reinforcement section, the wear is stopped and the stresses are diverted into the coater blade. Hereby, fissure forming is prevented at the transition section between the wear section and the rear part of the blade. Hereby, the life term of the blade may be considerably prolonged, since the wear section may be used to considerably more than the conventional 10–20% before it has to be exchanged due to wear and thereby following fissure formation in the ends of the blade.

The different thicknesses of the coatings, including the reinforcement section, are achieved in a continuous process for electrolytic nickel coating in two or more steps, by use of a total or partial masking of the different parts of the blade. Other process parameters too, such as current density, positioning of the strip in relation to the electrodes, i.e. the distance between the same, and the like, may be used in order to control the formation of the coatings in different positions of the blade. The process and the masking according to the invention are described in greater detail in connection with the drawings description below.

According to another aspect of the invention, the coatings are, at least on the underneath side of the blade at its wear section and a short distance beyond the transition section between the wear section and the rear part of the blade, formed of two or more layers having different compositions. At least two layers, preferably three or four layers, of different compositions are formed by the continuous process for electrolytic nickel coating in several steps (several cells), at least one of these layers comprising particles that increase the abrasion resistance of the coating (abrasion resistant particles). Such particles may e.g. be constituted by metal oxides, carbides or nitrides, e.g. $ZrO_2$, $Al_2O_3$, $SiO_2$, SiO, $TiO_2$, ZnO, SiC, TiC, SiN and/or cubic BN. Most preferred is use of SiC and/or cubic BN. Besides giving an increased hardness, such a layer counteracts the formation of burrs.

It is preferred that at least one other of these layers also comprises particles that increase the lubricating effect of the coating, preferably hexagonal BN. An alternative second layer or a third, outermost layer is preferably constituted by an electrolytic nickel coating essentially without a content of abrasion resistant or lubricating particles, whereby the outermost layer instead can be constituted by an electrolytic nickel coating which is free from additives apart from the additives that conventionally are used in connection with the application of such coatings or an electrolytic nickel coating which comprises additives of Teflon/PTFE type. By the concept "of Teflon/PTFE type" it is hereby meant additives such that the surface of the coater blade exhibits properties obstructing the adhesion of ingredients in the ink which is used by the end user together with the coater blade. Suitably, all layers in a multiple layer coating have about the same thickness.

Also on the top side of the blade, including the reinforcement section, the coating may be constituted by two, three or more layers according to the above, optionally of the same type and in the same order as on the underneath side. Suitably, but not necessarily, the greater part of the thickness of the coating at the reinforcement section may be constituted by a layer with abrasion resistant particles, the other layers exhibiting in the main the same thickness at the reinforcement section as at the wear section, on the top side of the blade. It is however also conceivable to use only one coating layer on the top side of the blade, which in that case suitably consists of a layer comprising abrasion resistant particles. As an alternative, there is made use of more than one layer both on the top side and on the underneath side, the number of layers however being greater on the underneath side than on the top side.

According to yet another aspect of the invention, the blade, in the rear part of its top and underneath side, only exhibits one coating layer, which is preferably constituted by an electrolytic nickel coating essentially without a content of particles or an electrolytic nickel coating comprising additives of the type Teflon/PTFE. However, it is of course also conceivable that the layer instead comprises other particles according to the above. Here, the coating layer suitably has a thickness of about 1–10 μm, preferably 1–6 μm. Alternatively, the rear part may exhibit two or more layers according to the above, the outermost layer being constituted by an electrolytic nickel coating essentially without a content of particles or an electrolytic nickel coating comprising additives of the type Teflon/PTFE.

According to yet another aspect of the invention, the outermost coating layer of the blade, preferably without any additives or only having additives of the type Teflon/PTFE, may be the same over the entire blade, whereby this outermost layer suitably is applied in a final electrolytic cell without masking.

The particle density of the particles used in the layers, depend to a certain degree on the particle size of the pigment which is to be used in the printing, when the blade is a coater blade. The less the size of the pigment particles, the greater the particle density in the layers. Typically, the lubricating particles, e.g. hexagonal BN, should be smaller than 4 μm, the abrasion resistant particles, e.g. SiC, should be smaller than 2 μm and the additives of the type Teflon/PTFE should be smaller than 5 μm. The thinner the layer, the smaller the particles. Typical contents of particles in the respective layers are 5–30% by volume, preferably 5–20% by volume and even more preferred 5–15% by volume.

When an outermost coating layer comprising additives of Teflon/PTFE or similar is used, the coating process is finished with a heat treatment step, e.g. at about 200–600° C., typically about 400° C., for a few minutes, typically 30 minutes at the most. In this heat treatment, superficial particles of PTFE will flow out into a thin, mainly even, surface layer of the outermost coating layer. According to the invention, this heat treatment may be combined with, i.e. performed at the same time as, a heat treatment step which is required to achieve an increased hardness in the layers when the electrolyte bath is of Ni—P type.

Typically there is achieved a hardness of about 640–800 Hv, in a coating layer comprising SiC according to the invention, when heat treatment is not used. When heat treatment is used, in connection with Ni—P baths or Ni baths including metal salts, including SiC, the hardness of this layer may be up to 800 Hv, preferably up to 900 Hv and even more preferred up to 1000 Hv. The hardness of a coating layer comprising hexagonal BN is typically about 620–700 Hv, and always lower than the layer comprising abrasion resistant particles, however higher than the hardness of the steel in the core of the blade.

BRIEF DESCRIPTION OF THE DRAWINGS

In the following, the invention will be described in greater detail with reference to the drawings, of which.

DETAILED DESCRIPTION OF THE DRAWINGS

Figure 1:
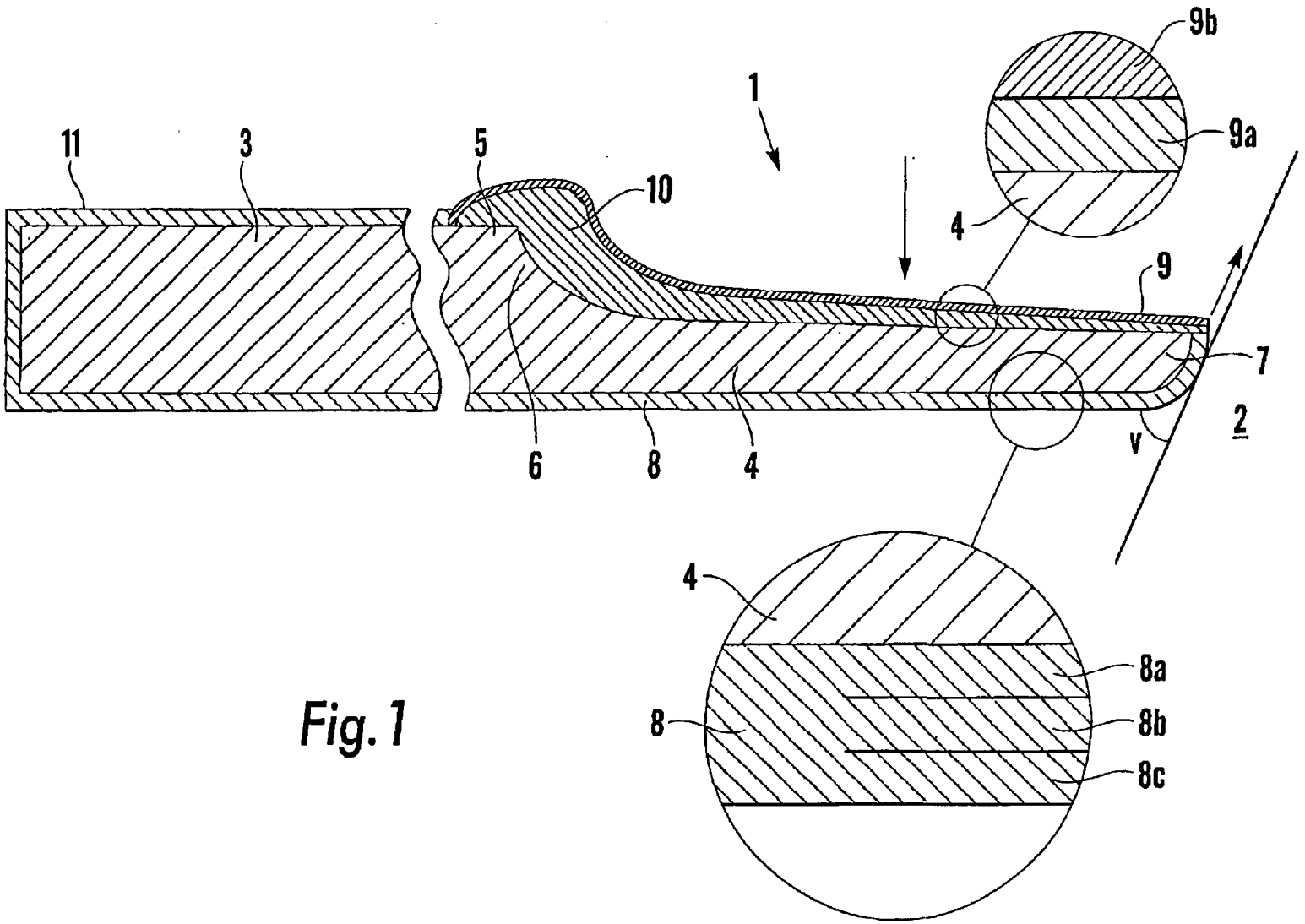
FIG. 1 is showing, in cross-section, a coater blade according to the invention, which butts against a roll.

In the following, the invention is exemplified by a coater blade 1 (FIG. 1), which is intended to be used to scrape off printing ink from a rotating roll 2, which roll normally is a so called anilox roll or engraving roll. During operation, the coater blade 1 is exposed to forces indicated by arrows.

The coater blade 1 exhibits a steel core, with about 0.5–1.2% C, which has been hardened to a hardness of about 550–750 Hv and has been lamella ground. By the concept of lamella grinding it is meant that the blade exhibits a rear, thicker part 3, normally 0.15–0.6 mm thick, for clamping in a holder (not shown) for the blade, and a front, thinner part 4, normally about 50 $\mu$m thick, which constitutes a wear section. At the transition between the rear part 3 and the wear section 4, the blade exhibits a sharp edge 5 on its top side, and thereafter a soft, gradual transition 6 down towards the wear section 4. On the underneath side, the blade 1 is entirely flat, except at the tip 7, which may be softly chamfered. The blade 1 may exhibit a total extension (width) of 8–120 mm in the shown cross-section, depending on whether the blade is a coater blade or a doctor blade. Normally, the edge 5 is situated less than 10 mm from the tip 7 of the blade.

On its underneath side, the blade 1 exhibits a coating 8, which is formed from at least two different layers 8*a*, 8*b*, 8*c* and which exhibits a total thickness of 10–20 $\mu$m. This underneath coating 8 may extend over the entire or essentially the entire underneath side of the blade, or only over the wear section 4 and a short distance past the transition section 5, 6. A coating 8 is arranged on the top side of the blade, which coating is formed from at least one layer 9*a*, 9*b* and which exhibits a total thickness of 3–15 $\mu$m, up to about 70% of the extension of the wear section, as seen from the tip of the blade. After these about 70% of the extension of the wear section, there is formed a reinforcement section 10, which has preferably been formed by the same type of layer as the coating 9, but in greater thicknesses, according to the above. The rear part 3 also exhibits at least one coating layer 11.

Figure 2:
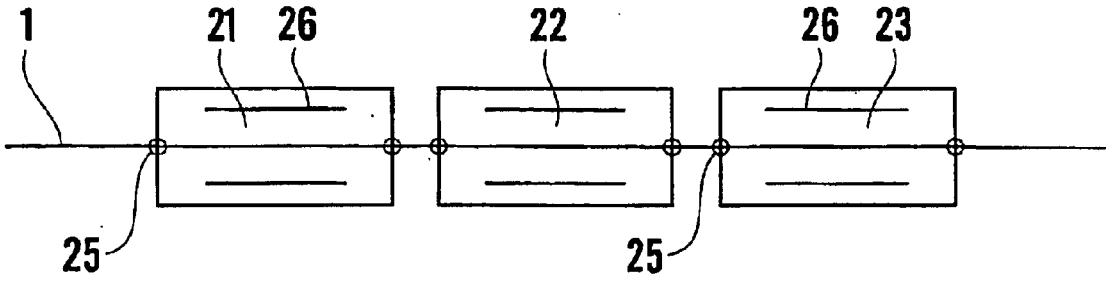
FIG. 2 is showing a block diagram over the coating process according to the invention.

In FIG. 2, there is shown a block diagram intended to illustrate the process for the electrolytic nickel coating according to the invention. The coater or doctor blade is brought to pass as a continuous strip through at least two, in the shown embodiment three electrolytic cells 21, 22, 23 with contact polarisation of the blade 1 via anodic electrode rollers 25. It is preferred that the cells are adequately wide so that two or more blades can be coated at the same time during continuous operation. Cathodic electrodes 26 are arranged in the cells 21, 22, 23. Due to carrying between the cells, the formed coating layers may be brought to contain a small amount of particles other than the ones specified as "nominal" for each layer. This is true also for layers stated to be without particles. However, this deviation from the nominal composition is so small that it will not affect the concept of the invention to any considerable degree.

Each cell 21, 22, 23 contains a Ni or Ni—P electrolyte bath of the type described in the above mentioned references from the journal Plating & Surface Finishing, i.e. normally comprising $NiSO_4$, $NiCl_2$, $H_3BO_3$ and optionally hypophosphorous acid, phosphorous acid or hypophosphite and/or saccharine, and at least in one of the cells additives in the form of abrasion resistant particles and/or lubricating particles and/or additives of the PTFE/Teflon type. Normally, the electrolytic cells operate at a temperature of about 40–60° C. and a current density of up to about 20 A/dm$^2$. The order between the cells and the masking in the same, according to below, may be varied and naturally depends on the desired end product.

Figure 3:
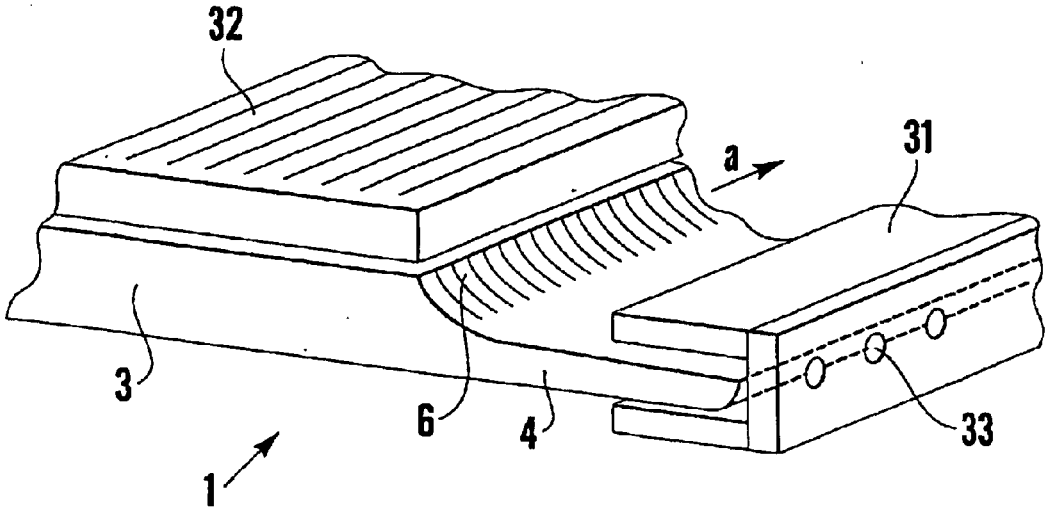
FIG. 3 is showing, in perspective, an example of how the masking of the coater blade can be accomplished during the coating process.

In FIG. 3, there is shown an example of how the strip 1, which is constituted by the coater blade, continuously runs in the cells 21, 22, 23 according to FIG. 2. In each of these cells, or at least in one or some of them, there is arranged one or more masking devices, whereof the shown masking devices 31, 32 constitute one example of how it can look in one of the cells. The masking devices are fixed in the electrolyte bath in a direction which corresponds to the running direction a of the strip, but are somewhat displaceable in the cross direction. In the shown embodiment, the masking devices are arranged so that a front part of the wear section 4 of the blade 1 is partly masked by the masking device 31. The masking device 31 is arranged to extend about the tip of the blade 1, and exhibits through holes 33 so that a minor part of the flowing electrolyte liquid is allowed to flow over the tip of the blade, despite the masking, in order there to form a thin coating. The masking device also gives a lower current density at the masked sections, which may however be somewhat increased by aid of the holes 33. A masking device 32 is also arranged to mask the top side of the coater blade, at its rear part 3. The transition section 6 and the underneath side of the coater blade are however not masked in the shown embodiment, leading to that thicker coatings 8, 10 (FIG. 1) can be formed there. It is to be understood that the shape of the through holes 33 may be varied, they may be circular or oblong e.g., rectangular or oval e.g.

By use of masking devices of different types in the different cells 21, 22 and 23, there is obtained a possibility to form different coating layers in combination with each other, having different thickness and different compositions in different positions of the blade. Accordingly, one may e.g. mask the entire rear part 3 of the blade, i.e. both its top side and its underneath side, in a first step (in a first cell), and only coat the front 10 millimeters of the blade by a first coating layer 8*a*, 9*a* (FIG. 1) of nickel comprising abrasion resistant particles. At the same time, one may by aid of masking, current density, the distance between the strip and the electrodes and other process parameters, control the physical forming of the coating layers according to the above. Thereafter, a covering layer without abrasion resistant particles but including lubricating particles may be applied on top of the particles in the first layer, in a second step (in a second cell 22) with essentially the same masking as in step 1. Finally, the front part of the blade may be masked entirely and its rear part 3 may instead be coated, e.g. by a pure Ni layer, in a third step (in a third cell 23).

EXAMPLE

In the following, there is exemplified in table 1 a number of different conceivable variants of electrolytically coated blade according to the invention. By front part is meant the wear section and reinforcement section, the front part of the underneath side extending all the way to and including the reinforcement section which is arranged on the top side. By "Ni" is meant a nickel coating which has been created by aid of electrolytic nickel coating according to the description above. The coating layers used have been numbered so that layer 1 is the layer closest to the blade. By the designations is meant:

A Ni comprising abrasion resistant particles

L Ni comprising lubricating particles

T Ni comprising additives of the type Teflon/PTFE

AL Ni comprising both abrasion resistant and lubricating particles

W Ni without any additives

TABLE 1

| | Variant | | | | | | | |
|---|---|---|---|---|---|---|---|---|
| | 1 | 2 | 3 | 4 | 5 | 6 | 7 | 8 |
| Underneath side: | | | | | | | | |
| Front part, layer 1 | A | A | A | L | L | L | L | L |
| Front part, layer 2 | L | AL | L | A | A | A | A | A |
| Front part, layer 3 | — | — | — | W | T | T | T | T |
| Rear part, layer 1 | W | W | W | W | T | A | W | L |
| Rear part, layer 2 | — | — | — | — | — | T | — | A |
| Rear part, layer 3 | — | — | — | — | — | — | — | T |
| Top side: | | | | | | | | |
| Front part, layer 1 | A | A | A | L | A | L | A | L |
| Front part, layer 2 | L | AL | — | A | T | A | — | A |
| Front part, layer 3 | — | — | — | W | — | T | — | T |
| Rear part, layer 1 | W | W | W | W | T | A | W | L |
| Rear part, layer 2 | — | — | — | — | — | T | — | A |
| Rear part, layer 3 | — | — | — | — | — | — | — | T |

The example is mainly intended to illustrate the great number of variants that can be achieved according to the invention. The skilled man will also realise that a number of other combinations can be made.

The invention is not limited to the described embodiments but may be varied within the scope of the claims. Especially, it is realised that the skilled man, without any inventive work, can compose other combinations of coating layers and how these are to be manufactured in the process according to the invention, by use of in series arranged electrolytic cells having masking adapted to the desired product.

What is claimed is:

1. Doctor or coater blade comprising:

a steel blade having a front part, a rear part, an underneath side and a top side;

an electrolytic nickel coating comprising abrasion resistant particles, wherein said coating comprises an electrolytic nickel layer comprising abrasion resistant particles, which nickel layer comprises a first coating layer arranged at least on the underneath side of the front part of the blade; and a second coating layer at least on the underneath side of the front part, which second coating layer comprises an electrolytic nickel layer comprising lubricating particles and/or additives of Teflon/PTFE type, or is substantially free from abrasion resistant or lubricating particles and additives of Teflon/PTFE type.

2. Doctor or coater blade according to claim 1, wherein the front part is thinner than the rear part of said blade and said front part comprises a wear section while said rear part comprises an attachment part.

3. Doctor or coater blade comprising:

a steel blade having a front part, a rear part, an underneath side and a top side;

an electrolytic nickel coating comprising abrasion resistant particles, wherein said coating comprises an electrolytic nickel layer comprising abrasion resistant particles, which nickel layer comprises a first coating layer arranged at least on the underneath side of the front part of the blade; and at least one electrolytic nickel layer on the top side of the front part of the blade and at least two electrolytic nickel layers on the underneath side of the front part of the blade, the number of electrolytic nickel layers being greater on the underneath side of the blade than on the top side.

4. Doctor or coater blade according to claim 3, wherein said at least one electrolytic nickel layer on the top side of the front part comprises an electrolytic nickel layer comprising abrasion resistant particles.

5. Doctor or coater blade according to claim 1, wherein said abrasion resistant particles are present in an amount of 5–30 vol-% in the coating layer, that they have a particle size less than 2 $\mu$m, and the particles comprise one or more metal oxides, metal carbides or metal nitrides.

6. Doctor or coater blade according to claim 4, wherein said at least one electrolytic nickel layer on the top side of the front part also comprises an electrolytic nickel layer comprising lubricating particles and/or additives of Teflon/PTFE type, or which is substantially free from abrasion resistant or lubricating particles and additives of Teflon/PTFE type.

7. Doctor or coater blade according to claim 1, wherein said lubricating particles and/or said additives of Teflon/PTFE type are present in an amount of 5–30 vol-% in the second coating layer, that they have a particle size less than 5 $\mu$m, and that they comprise hexagonal BN and/or PTFE.

8. Doctor or coater blade according to claim 1, further comprising at least one electrolytic nickel layer on the rear part of the blade having a thickness of 1–10 $\mu$m.

9. Doctor or coater blade according to claim 1, wherein an outermost coating layer comprises a uniform electrolytic nickel layer covering essentially the entire blade.

10. Doctor or coater blade comprising:

a steel blade having a front part, a rear part, an underneath side and a top side; and an electrolytic nickel coating comprising abrasion resistant particles, wherein said coating comprises an electrolytic nickel layer comprising abrasion resistant particles, which nickel layer comprises a first coating layer arranged at least on the underneath side of the front part of the blade, wherein a total coating on the underneath side of the front part of the blade has a greater thickness than a total coating on the top side of the front part of the blade, the total thickness of the coating on the underneath side being 8–25 $\mu$m, while the total thickness of the coating on the top side is 13–15 $\mu$m.

11. Doctor or coater blade comprising:

a steel blade having a front part, a rear part, an underneath side and a top side; and an electrolytic nickel coating comprising abrasion resistant particles, wherein said coating comprises an electrolytic nickel layer comprising abrasion resistant particles, which nickel layer comprises a first coating layer arranged at least on the underneath side of the front part of the blade, wherein the blade comprises a reinforcement section, comprising at least one coating layer on the top side of the blade, at a transition section between the front part of the blade, which front part comprises a wear section, and the rear part of the blade, which reinforcement section has a largest thickness which is greater than a thickness of a total coating on the top side of the front part of the blade.

12. Method of coating a doctor or coater blade of steel with a coating of nickel comprising abrasion resistant particles, wherein said blade is brought to continuously run in one or more electrolytic cells holding an electrolyte liquid comprising at least one nickel salt, and in at least one of these cells also comprising abrasion resistant particles, one or more sections of the blade, in at least one of said cells, being completely or partially masked for a flow of electrolytic liquid and for current destiny, by use of one or more masking devices, so that a first coating layer comprising an electrolytic nickel layer comprising abrasion resistant particles, is arranged at least on an underneath side of a front part of the blade, and further conducting the method to provide a second coating layer at least on the underneath side of the front part, which second coating layer comprises an electrolytic nickel layer comprising lubricating particles and/or additives of Teflon/PTFE type, or is substantially free from abrasion resistant or lubricating particles and additives of Teflon/PTFE type.

13. Method according to claim 12, wherein the abrasion resistant particles exhibit a particle size less than 2 $\mu$m, and that they comprising one or more metal oxides, metal carbides or metal nitrides.

14. Method according to claim 12, wherein the blade is brought to run in series through said cell having abrasion resistant particles and thereafter and/or before in at least one electrolytic cell holding an electrolytic liquid comprising at least one nickel salt.

15. Method according to claim 14, wherein the electrolytic liquid comprises lubricating particles and/or additives of Teflon/PTFE type having a particle size less than 5 $\mu$m, and that said lubricating particles comprise hexagonal BN.

16. Method according to claim 12, wherein said cells operate by contact polarisation of the blade via anodic electrode rollers and cathode electrodes arranged in the cell.

17. Method according to claim 12, wherein said one or more masking devices is/are fixedly arranged in the cell in a running direction of the blade.

18. Method according to claim 12, wherein build-up of nickel coating formed on the blade is controlled by said masking and preferably also by controlling of the current density in the cell and/or by controlling of a distance between the blade and electrodes arranged in the cell.

19. Method according to claim 12, wherein the blade, after having been coated by the nickel coating, is heat treated.

20. Doctor or coater blade according to claim 4, wherein said abrasion resistant particles are present in an amount of 5–30 vol-% in the coating layer, that they have a particle size less than 2 $\mu$m, and the particles comprise one or more metal oxides, metal carbides or metal nitrides.

21. Doctor or coater blade according to claim 5, wherein said abrasion resistant particles are present in an amount of 5–20 vol-% in the coating layer.

22. Doctor or coater blade according to claim 5, wherein said abrasion resistant particles are present in an amount of 5–15 vol-% in the coating layer.

23. Doctor or coater blade according to claim 5, wherein said abrasion resistant particles comprise at least one selected from the group consisting of $ZrO_2$, $Al_2O_3$, $SiO_2$, SiO, TiO, ZnO, SiC, TiC, SiN and cubic BN.

24. Doctor or coater blade according to claim 6, wherein said lubricating particles and/or said additives of Teflon/PTFE type are present in an amount of 5–30 vol-% in the second coating layer, that they have a particle size less than 5 $\mu$m, and that they comprise hexagonal BN and/or PTFE.

25. Doctor or coater blade according to claim 7, wherein said lubricating particles and/or said additives of Teflon/PTFE type are present in an amount of 5–20 vol-% in the second coating layer.

26. Doctor or coater blade according to claim 7, wherein said lubricating particles and/or said additives of Teflon/PTFE type are present in an amount of 5–15 vol-% in the second coating layer.

27. Doctor or coater blade according to claim 8, wherein there is not more that one electrolytic nickel layer on the rear part.

28. Doctor or coater blade according to claim 8, wherein the thickness of the electrolytic nickel layer on the rear part is 1–6 $\mu$m.

29. Doctor or coater blade according to claim 10, wherein the total thickness of the coating on the underneath side is 10–20 $\mu$m and the total thickness of the coating on the top side is 3–10 Fm.

30. Doctor or coater blade according to claim 10, wherein the total thickness of the coating on the underneath side is 13–18 $\mu$m and the total thickness of the coating on the top side is 3–10 $\mu$m.

31. Doctor or coater blade according to claim 11, wherein the reinforcement section has a largest thickness which is greater than a thickness of a total coating on the underneath side of the front part of the blade.

32. Doctor or coater blade according to claim 11, wherein the largest thickness of the reinforcement section is 10–40 $\mu$m.

33. Doctor or coater blade according to claim 11, wherein the largest thickness of the reinforcement section is 13–35 $\mu$m.

34. Method according to claim 13, wherein the abrasion resistant particles comprise at least one selected from the group consisting of $ZrO_2$, $Al_2O_3$, $SiO_2$, SiO, $TiO_2$, ZnO, SiC, TiC, SiN and cubic BN.

35. Method according to claim 13, wherein the blade is brought to run in series through said cell having abrasion resistant particles and thereafter and/or before in at least one electrolytic cell holding an electrolytic liquid comprising at least one nickel salt.

36. Method according to claim 14, wherein the blade the electrolytic liquid comprises lubricating particles and/or additives of Teflon/PTFE type.

37. Method according to claim 35, wherein the blade the electrolytic liquid comprises lubricating particles and/or additives of Teflon/PTFE type.

38. Method according to claim 14, wherein the electrolytic liquid is free from abrasion resistant or lubricating particles and additives of Teflon/PTFE type.

39. Method according to claim 19, wherein the blade is heat treated at 200–600 EC for 30 minutes at the most.

40. Method of coating a doctor or coater blade of steel with a coating of nickel comprising abrasion resistant particles, wherein said blade is brought to continuously run in one or more electrolytic cells holding an electrolyte liquid comprising at least one nickel salt, and in at least one of these cells also comprising abrasion resistant particles, one or more sections of the blade, in at least one of said cells, being completely or partially masked for a flow of electrolytic liquid and for current destiny, by use of one or more masking devices, so that a first coating layer comprising an electrolytic nickel layer comprising abrasion resistant particles, is arranged at least on an underneath side of a front part of the blade, and further conducting the method to provide at least one electrolytic nickel layer on the top side of the front part of the blade and at least two electrolytic nickel layers on the underneath side of the front part of the blade, the number of electrolytic nickel layers being greater on the underneath side of the blade than on the top side.

41. Method of coating a doctor or coater blade of steel with a coating of nickel comprising abrasion resistant particles, wherein said blade is brought to continuously run in one or more electrolytic cells holding an electrolyte liquid comprising at least one nickel salt, and in at least one of these cells also comprising abrasion resistant particles, one or more sections of the blade, in at least one of said cells, being completely or partially masked for a flow of electrolytic liquid and for current destiny, by use of one or more masking devices, so that a first coating layer comprising an electrolytic nickel layer comprising abrasion resistant particles, is arranged at least on an underneath side of a front part of the blade, wherein the method is conducted to provide a total coating on the underneath side of the front part of the blade having a greater thickness than a total coating on the top side of the front part of the blade, the total thickness of the coating on the underneath side being 8–25 $\mu$m, while the total thickness of the coating on the top side being 13–15 $\mu$m.

42. Method of coating a doctor or coater blade of steel with a coating of nickel comprising abrasion resistant particles, wherein said blade is brought to continuously run in one or more electrolytic cells holding an electrolyte liquid comprising at least one nickel salt, and in at least one of these cells also comprising abrasion resistant particles, one or more sections of the blade, in at least one of said cells, being completely or partially masked for a flow of electrolytic liquid and for current destiny, by use of one or more masking devices, so that a first coating layer comprising an electrolytic nickel layer comprising abrasion resistant particles, is arranged at least on an underneath side of a front part of the blade, wherein the method is conducted to provide a reinforcement section comprising at least one coating layer on the top side of the blade at a transition section between the front part of the blade, which front part comprises a wear section, and the rear part of the blade, which reinforcement section has a largest thickness which is greater than a thickness of a total coating on the top side of the front part of the blade.

* * * * *